United States Patent [19]

Walser et al.

[11] 4,056,062

[45] Nov. 1, 1977

[54] MAGAZINE FOR CASELESS CHARGES

[75] Inventors: Karl Walser, Nendeln, Liechtenstein; Kurt Schmid, Altenstadt, Austria; Ralph Scotoni, Triesen, Liechtenstein

[73] Assignee: Hilti Aktiengesellschaft, Schaan, Liechtenstein

[21] Appl. No.: 708,303

[22] Filed: July 26, 1976

Related U.S. Application Data

[63] Continuation of Ser. No. 438,677, Feb. 1, 1974, abandoned.

[30] Foreign Application Priority Data

Feb. 2, 1973 Germany ..... 2305219

[51] Int. Cl.[2] ..... F42B 39/08

[52] U.S. Cl. ..... 102/86.5; 89/35 R

[58] Field of Search ..... 42/39.5; 102/86.5, DIG. 1; 89/35 R, 33 MC, 43 P, DIG. 1

[56] References Cited

U.S. PATENT DOCUMENTS

| | | | |
|---|---|---|---|
| 3,225,482 | 12/1965 | Olson | 42/89 |
| 3,318,245 | 5/1967 | Ferri et al. | 102/86.5 |
| 3,349,710 | 10/1967 | Sposimo | 102/86.5 |
| 3,410,213 | 11/1968 | Stadler et al. | 102/39 |
| 3,435,765 | 4/1969 | Gawlick | 102/43 P X |
| 3,529,548 | 9/1970 | Gawlick et al. | 102/86.5 X |
| 3,611,870 | 10/1971 | Udert et al. | 102/86.5 X |
| 3,625,153 | 12/1971 | Gawlick et al. | 102/86.5 |
| 3,625,154 | 12/1971 | Gawlick et al. | 102/86.5 |

FOREIGN PATENT DOCUMENTS

| | | | |
|---|---|---|---|
| 627,146 | 10/1961 | Italy | 102/86.5 |

*Primary Examiner*—David H. Brown

*Attorney, Agent, or Firm*—Toren, McGeady and Stanger

[57] ABSTRACT

In a magazine for use in an explosive powder driven bolt setting gun, a cartridge holding space for a caseless charge is formed by the combination of a cartridge recess in a band-shaped magazine body and a torus-shaped body superposed on the magazine body and forming an extension of the recess. Various configurations of the cartridge holding space and the exterior of the torus-shaped body can be used and a variety of openings can be provided through the cartridge holding space to prevent destruction of the magazine parts when the caseless charge is ignited.

8 Claims, 16 Drawing Figures

MAGAZINE FOR CASELESS CHARGES

This is a continuation of application ser. no. 438,677 filed Feb. 1, 1974, now abandoned.

SUMMARY OF THE INVENTION

The present invention is directed to a magazine for use in an explosive powder driven bolt setting gun, and, more particularly, it concerns the arrangement of the magazine to form a cartridge holding space within which a caseless charge is secured.

Disposable magazines for use in explosive powder driven bolt setting guns have been known, and in such magazines the cartridges, formed within casings, have been fitted into recesses in the magazine body. When these magazines are employed in explosive powder driven bolt setting guns, disadvantages are experienced because of the type of cartridge used. Primarily, the disadvantages stem from the deposit of impurities in the firing mechanism of the bolt setting gun and also in the high costs of the casings for the cartridges.

To improve the efficiency and economy of such bolt setting guns, there has been increased use of caseless charges. The caseless charges are pressed powder members which have different forms, for instance, tablets, cubes, cylinders and the like. In most instances the caseless charges are packed in great numbers in a container. This type of packing presents problems, because the charges which are relatively small, are difficult to remove from the containers and to insert into a bolt setting gun. Moreover, storing a large number of such charges in a small space, as when they are packed in a container, is not without danger, since they can easily catch fire or even be detonated.

Therefore, to avoid the disadvantages experienced in the past, the present invention proposes the arrangement of caseless charges in cartridge holding spaces formed in a magazine body.

Positioning the caseless charges in spaced apart relationship in the cartridge holding spaces provides a clearly defined safety separation between the individual charges, so that the handling as well as the storage of the charges is completely safe. Furthermore, any unburnt or incompletely burnt charges remain in the holding spaces in case of a misfire. Since the magazine body forms a part of the cartridge chamber, any unburnt or partly burnt charge is removed from the range of the firing mechanism of the bolt setting gun during the feed of the magazine and a new charge is positioned in the firing mechanism. Accordingly, the charge residues which remain in the cartridge holding space are prevented from igniting when a new charge is ignited. If a new charge and anything left over from a misfire were ignited at the same time, higher propulsion pressures would be developed which could not be recognized in advance.

To prevent the caseless charges from being damaged as the magazine is fed into the bolt setting gun, the height of the cartridge holding space formed in the magazine body and in the torus mounted on the magazine body provide a height which exceeds that of the charge. As a result, it is impossible for the charge to be torn out of the recess by the magazine feeding device before it reaches the cartridge chamber.

The charges inserted into the magazine can assume various shapes, for instance, they may be tablet or H-shaped. In addition, a primer composition can be included in the charge and the location of the primer composition is not significant.

For the proper feed of the magazine it is naturally important that the magazine retain its original shape even after the charge positioned in the cartridge holding space has been ignited and it is not partly deformed or destroyed by the pressures generated at ignition. It has been found that the destruction of the magazine parts surrounding the charge can be prevented if the end face of the charge, on the ignition side, is connected by channels, recesses or similar passages with the space defined by the opposite end face. Such connection can be afforded by providing passages through the charge from one end face to the other, for example in the form of bores through the charge. However, a similar effect can be attained if the charge is provided with recesses at its peripheral side or edge, for example, in the form of notches or flattened surfaces. It is not necessary to provide any special design for the charge if the surface of the cartridge holding space is shaped to provide the channels so that a direct connection or communication is provided between the opposite end faces of the charge. Further, there is no special design required for the charge if the surface of the cartridge holding space forms projections which extend inwardly into contact with the peripheral surface of the charge. These passages or connections permit expansion of the powder gases generated at the commencement of the ignition of the charge so that such gases do not act exclusively on the portions of the magazine which enclose the charge. Moreover, it has been found that the energy yield in such a charge support arrangement is considerably increased.

Since the magazine forms a part of the cartridge chamber, it provides an essential part of the packing for the charge during ignition, accordingly, the outer surface of the torus positioned on the magazine body has a frusto-conical shape tapering inwardly as it projects outwardly from the magazine body.

To assure that the caseless charge is firmly held within the catridge holding space to avoid displacement of the charge, even under strong vibration, the interior of the holding space has a frusto-conical shape tapering inwardly towards its outlet end and with the exterior wall of the torus being cylindrically-shaped. To insure the proper packing between the magazine and the bolt setting gun, it is also possible to provide the exterior surface of the torus with a frusto-conical shape. Further, the flow of the explosion gases to the outlet channels in the bolt setting gun is greatly facilitated if the torus has one or several openings which commence at its end face spaced from the magazine body.

The caseless charges are held firmly in the magazine, particularly if the cartridge holding spaces are closed by the magazine body. Such an arrangement prevents, to a great extent, the charges from being displaced from the magazine. However, to prevent the closure in the bottom of the cartridge holding spaces from hindering the ignition of the charge, passages are provided through the magazine body into the base of the holding space to admit the firing pin. It has also been found that it is possible to ignite the charge without using a firing pin. Where a firing pin is not used, one or a number of projections are provided in the base of the cartridge holding space in place of passages. Such projections, which can be in the form of a centrally arranged cylindrically-shaped projection, can act in providing ignition of the charge.

To prevent any displacement of the charge during ignition which would impair the firing action, the outer end of the torus is provided with an inwardly projecting ring-shaped shoulder which affords an ignition abutment for the caseless charge.

To move the magazine through the bolt setting gun, it is provided with recesses or slots along one or both sides into which the magazine feeding elements on the gun seat. A wide variety of openings or shaped configurations of the magazine body can be used to cooperate with the feeding elements on the bolt setting gun.

Another feature of the invention involves the use of a disk-shaped magazine body so that the charges are moved into the firing position by rotating the magazine. When such a disk-shaped magazine body is used, it is preferable if recesses are provided in its edge region for engagement by the feeding elements of the gun, such feeding elements providing the rotation of the magazine.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
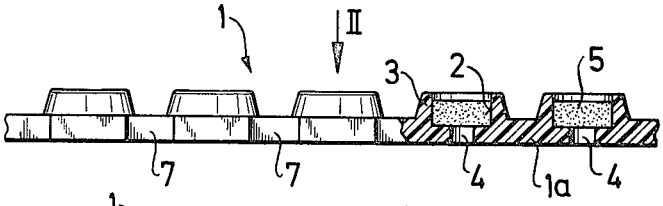
FIG. 1 is a side view, partly in section, of a magazine embodying the present invention.
Figure 2:
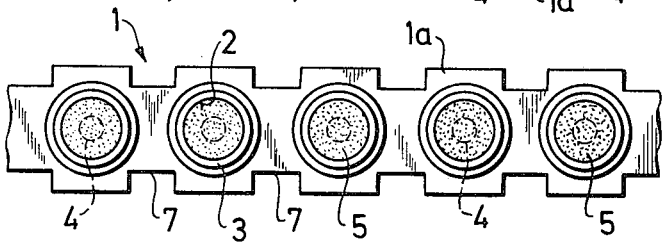
FIG. 2 is a plan view of the magazine shown in FIG. 1.

As illustrated in FIGS. 1 and 2, the magazine is formed of a flat, band-shaped magazine body 1 in which a plurality of cartridge recesses 2 are formed extending inwardly from the upwardly facing surface of the magazine body. Mounted on the upper surface of the magazine body, as viewed in FIG. 1, are torus-shaped walls 3 each encircling one of the cartridge recesses with the combination of the interior of one cartridge recess and the interior of its associated torus-shaped body forming a cartridge holding space. As indicated in FIGS. 1 and 2, the magazine body and the torus-shaped wall 3 are integral and are formed of the same material. Instead of this integral arrangement, for which a plastic material would be suitable, the torus-shaped wall 3 could be formed separately from the magazine body 1 and attached to it. Further, different materials could be used for forming the magazine body and the torus-shaped walls.

Caseless charges 5 are inserted into each of the cartridge holding spaces formed by the combination of the cartridge recesses 2 and the torus-shaped walls 3. The bottom surface 1*a* of the magazine, that is, the downwardly facing surface viewed in FIG. 1, forms a closure for the cartridge recess and has a passage 4 extending between the base of the cartridge recess and the bottom surface 1*a*. As illustrated in FIG. 1, the surface forming the cartridge recess 2 is cylindrical as is the inner surface of the torus-shaped wall 3, however, the radially outer surface of the wall is frusto-conically shaped and tapers inwardly as it extends outwardly away from the magazine body 1. The frusto-conical taper of the radially outer surface of the torus-shaped wall 3 increases the packing effect in the rear end of the gun barrel during the ignition of the charge 5 by means of a firing pin in the gun which contacts the charge through the opening 4 in the bottom of the magazine body. Despite the manner in which the magazine is secured within the bolt setting gun, to provide proper flow of the explosive powder gases to the outlet channels arranged in the rear end of the barrel, openings, not shown are provided which extend from the front or upper edge of the torus-shaped walls 3. The number or location of the openings can be selected as desired and only the position of the outlet channels in the rear end of the gun barrel influence their location.

Furthermore, as can be seen in FIG. 2, recesses 7 are provided in the edges of the magazine body 1. The recesses 7 can be shaped in accordance with the conditions encountered within a particular bolt setting gun so that the magazine feeding elements of the gun can position the cartridge holding spaces in alignment with the firing mechanism in the gun. The symmetrical arrangement of the recesses is not required for effective operation, however, it facilitates the handling of the magazine, since it can be introduced into the gun from both sides.

Figure 3:
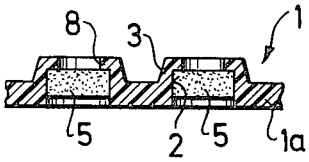
FIG. 3 is a sectional view through a portion of the magazine containing another embodiment of the present invention.

In FIG. 3, the bottom surface 1*a* of the magazine body is open and the opposite end of the cartridge holding space formed by the torus-shaped wall 3 is partially closed by an inwardly projecting ring-shaped abutment 8 extending about the inner periphery of the torus. As can be noted from the drawing, the caseless charge 5 is seated against the ring-shaped abutment 8 and its oppositely disposed face is recessed inwardly from the bottom surface 1*a* of the magazine body 1.

Figure 4:
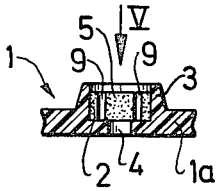
FIG. 4 is a sectional view through a portion of a magazine illustrating still another embodiment of the present invention.
Figure 5:
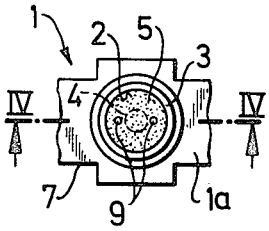
FIG. 5 is a plan view of the magazine shown in FIG. 4.
Figure 6:
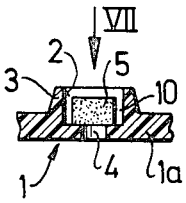
FIG. 6 is a sectional view of a portion of a magazine displaying yet another embodiment of the present invention.
Figure 7:
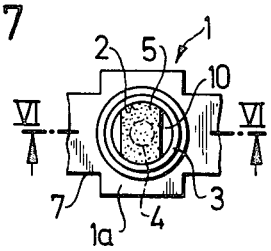
FIG. 7 is a plan view of the magazine shown in FIG. 6.

In FIGS. 4 to 13 various embodiments of the magazine are illustrated with the face on the lower or ignition side of the caseless charge 5 connected by means of passages with its opposite end face. These passages, which provide for expansion of the explosive powder gases generated during ignition, can be provided in the form of bores 9 extending axially through the charge 5, as shown in FIGS. 4 and 5. Instead of the bores 9, the passages can be formed as recesses 10 provided in the sides of the charge 5 extending between its end faces, note FIGS. 6 and 7. The form of the recesses 10 can be selected as desired, and the flat surfaces as shown in FIGS. 6 and 7 are particularly desirable because they are easy to form. Other possibilities for the passages consist in shaping the charges 5 with any desired geometric form which is different from the form of the cartridge recesses 2 so that the side surfaces of the charges form, in combination with the surface forming the recesses, passages extending between the end faces of the charge.

Figure 8:
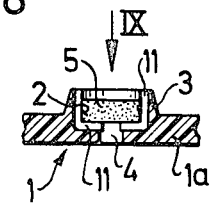
FIG. 8 is sectional view through a portion of a magazine illustrating still another embodiment of the present invention.
Figure 9:
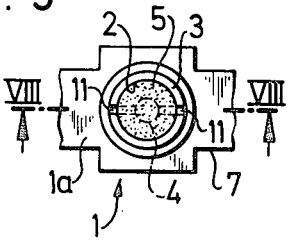
FIG. 9 is a plan view of the magazine shown in FIG. 8.

In FIGS. 8 and 9 the interior of the cartridge holding space outwardly from the circumferential periphery of the charge 5 is formed into channels 11 and, as a result, no special configuration is provided for the circumferential sides of the charges.

Figure 10:
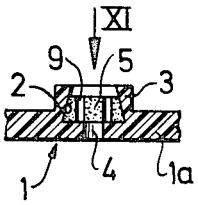
FIG. 10 is a sectional view through a portion of a magazine illustrating a still further embodiment of the present invention.
Figure 11:
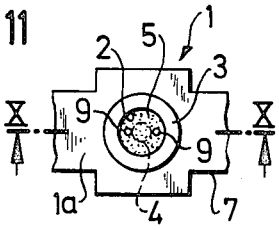
FIG. 11 is a plan view of the magazine shown in FIG. 10.

In FIGS. 10 and 11, an arrangement of the cartridge holding space is provided which assures that the charges 5 cannot be displaced from the holding spaces under any circumstances. As in FIG. 1, the bottom 1*a* of the magazine body 1 is closed across the holding space with only an opening 4 provided. The interior of the holding space is frusto-conically shaped with the surfaces tapering inwardly toward the upper or the free end of the torus-shaped wall 3. The charges 5 can be inserted into the frusto-conically shaped cartridge holding spaces by pouring or pressing the charges into the space while they are still wet. The passages through the charges provided by the bores 9, are shown only as examples and can be formed in any other way.

Figure 12:
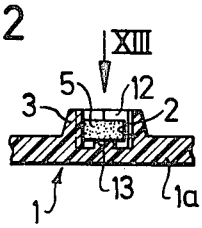
FIG. 12 is a sectional view of a portion of a magazine illustrating yet a further embodiment of the present invention.
Figure 13:
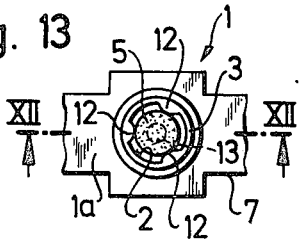
FIG. 13 is a plan view of the magazine illustrated in FIG. 12.

In FIGS. 12 and 13 another arrangement for holding the charges within the holding spaces are shown which require no special design or configuration for the circumferential sides of the charges. In the embodiment of the magazine shown in FIGS. 12 and 13, separate and angularly spaced projections 12 are formed on the inner wall of the cartridge recess and extend into contact with the circumferential peripheral surface of the charge. Further, these two figures show an embodiment of a magazine for use in guns without any separate firing pin. To facilitate ignition, an upwardly extending cylindrically shaped projection 13 is formed on the base of the recess 2 which extends upwardly to contact with the bottom surface of the charge 5 and serves as a substitute for a firing pin.

Figure 14:
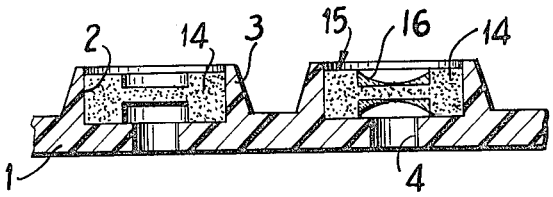
FIG. 14 is an enlarged sectional view through a portion of a magazine similar to FIG. 1 but illustrating a different form of the charge within the magazine.

In FIG. 14 in place of the tablet or short cylindrically shaped charges 5 shown in FIG. 1, H-shaped charges 14 are illustrated, that is, in section the charges have an H-shape. Further, the right hand charge 15, as viewed in FIG. 14, includes not only the propellant or explosives charge 14 but also a primer composition in the form of a cast-in ignition member 16.

Figure 15:
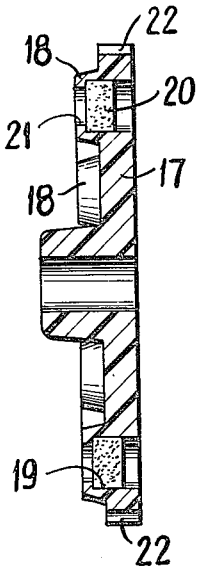
FIG. 15 is a sectional view through a different embodiment of the magazine.
Figure 16:
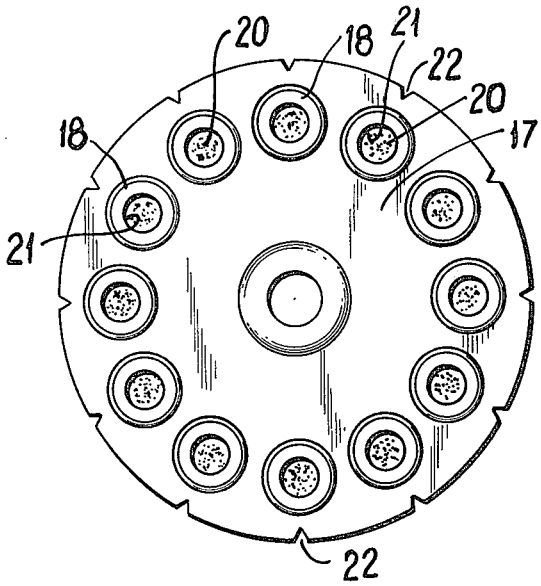
FIG. 16 is a plan view of the magazine shown in FIG. 15.

In FIGS. 15 and 16 a circular or disk shaped magazine body 17 which, as distinguished from the magazine body 1 described above, is arranged to be rotated for moving the charges into the firing position. A ring of recesses 19 are formed in the magazine body concentric to its central axis and on one face each recess is circled by a torus-shaped wall 18. The combination of the torus-shaped walls 18 and the recesses 19 form a plurality of cartridge holding spaces each containing a caseless charge 20. Each of the walls 18 defines an opening 21 and the disk-shaped magazine could be provided with any of the bores or passage described above. On the outer periphery of the magazine body 17 notches 22 are formed for engagement with the magazine feeding elements in a bolt setting gun for moving the charges one-by-one into the firing position.

As is known, charges of varying strengths differ from each other by the height of the charge. These various strength charges do not require any special design but can all be inserted into the same magazine. The only factor which must be taken into account is that the height of the strongest charge 5 used must not exceed the combined height of the cartridge recess 2 and the inner wall of the torus-shaped wall 3 which combine to form the cartridge holding space. With this height relationship it assures that the charges 5 do not extend outwardly from the magazine body 1 or the torus-shaped wall 3, so that the charges are protected against any damage as the magazine if fed through the magazine channel in the bolt setting gun prior to firing the caseless charges.

While specific embodiments of the invention have been shown and described in detail to illustrate the application of the inventive principles, it will be understood that the invention may be embodied otherwise without departing from such principles.

We claim:

1. A magazine for use in an explosive powder driven bolt setting gun comprising a substantially flat band-shaped magazine body having a first substantially flat face surface and a second substantially flat face surface oppositely directed from said first face surface, a cartridge recess formed in said magazine body extending inwardly from said first face surface, a torus-shaped wall mounted on and extending outwardly from the first face surface of said magazine body and encircling the recess and forming in combination therewith a cartridge holding space, wherein the improvement comprises a caseless charge held in the cartridge holding space defined by said cartridge recess and torus-shaped wall with said caseless charge disposed in surface contact with the annular surface within said cartridge recess and the inner surface of said torus-shaped wall which extends transversely of said first and second face surfaces, said caseless charge being capable of generating explosive gases when ignited for driving a bolt from a setting gun into a receiving material, said cartridge recess being closed by the second face surface of said magazine body and the base of said recess closed by said magazine body being a planar surface and having a projection extending outwardly therefrom in said cartridge holding space with said projection being spaced inwardly from the annular surface within said cartridge holding space which extends transversely of said first and second face surfaces and with which said caseless charge is in surface contact, said projection having a free end surface spaced from the base of said recess and located inwardly from the outer end of said cartridge holding space defined by said torus-shaped wall.

2. A magazine, as set forth in claim 1, wherein said caseless charge located in said cartridge holding space is tablet-shaped.

3. A magazine, as set forth in claim 1, wherein said magazine body has a pair of spaced edges extending between its first and second face surfaces and recesses formed in at least one of said edges with the recesses arranged to engage a feeding means in a bolt setting gun for moving said magazine body through the gun.

4. A magazine, as set forth in claim 1, wherein the surface of said cartridge recess extending in the direction between the first and second face surfaces of said magazine body has angularly spaced inwardly extending projections for holding said caseless charge within the cartridge holding space.

5. A magazine, as set forth in claim 1, wherein the dimension of the cartridge holding space extending in the axial direction of said torus-shaped wall outwardly from the free end surface of said projection is at least equal to the maximum height of said caseless charge.

6. A magazine, as set forth in claim 1, wherein said torus-shaped wall is formed integrally with said magazine body.

7. A magazine, as set forth in claim 1, wherein said magazine body is elongated and contains a plurality of serially arranged cartridge recesses and torus-shaped walls forming a plurality of cartridge holding spaces therein.

8. A magazine, as set forth in claim 7, wherein each said caseless charge is mounted in one of said cartridge recesses in said magazine body and extends therefrom into the space formed within said torus-shaped wall.

* * * * *